US006154191A

United States Patent [19]

Okita

[11] Patent Number: 6,154,191

[45] **Date of Patent: *Nov. 28, 2000**

[54] SYSTEM AND METHOD FOR DRIVING A NEMATIC LIQUID CRYSTAL

[75] Inventor: Masaya Okita, Tokyo, Japan

[73] Assignee: FAD Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,883

[22] Filed: Feb. 26, 1997

[30] Foreign Application Priority Data

Aug. 6, 1996 [JP] Japan ..... 8-221827

[51] Int. Cl.[7] ..... G09G 3/36

[52] U.S. Cl. ..... 345/95; 345/92; 345/96

[58] Field of Search ..... 345/94, 95, 96, 345/92

[56] References Cited

U.S. PATENT DOCUMENTS

| | | | |
|---|---|---|---|
| 4,608,558 | 8/1986 | Amstutz et al. | 345/94 |
| 4,687,956 | 8/1987 | Itoh | 327/108 |
| 4,795,239 | 1/1989 | Yamashita et al. | 345/95 |
| 4,962,376 | 10/1990 | Inoue | 345/97 |
| 5,300,945 | 4/1994 | Iemoto et al. | 345/92 |
| 5,648,793 | 7/1997 | Chen | 345/96 |
| 5,684,503 | 11/1997 | Nomura et al. . | |
| 5,694,147 | 12/1997 | Gaalema | 345/101 |
| 5,748,170 | 5/1998 | Goto | 345/101 |
| 5,777,591 | 6/1998 | Katoh | 345/92 |

FOREIGN PATENT DOCUMENTS 1-17994 7/1989 Japan .

*Primary Examiner*—Steven J. Saras
*Assistant Examiner*—Alecia D. Nelson
*Attorney, Agent, or Firm*—Flynn, Thiel, Boutell & Tanis, P.C.

[57] ABSTRACT

A system for driving a nematic liquid crystal is used to display high-definition color images at a high speed in a liquid crystal display device in which the nematic liquid crystal is confined between a common electrode and a segment electrode that are placed between two polarizing plates. The common electrode is supplied with a sequence of selection pulses, and the segment electrode is supplied with a voltage corresponding to image data to be displayed in response to the selection pulses. The segment electrode is further supplied with a voltage different from the voltage corresponding to the image data in intervals where the selection pulses are not applied to the common electrode.

4 Claims, 5 Drawing Sheets

SYSTEM AND METHOD FOR DRIVING A NEMATIC LIQUID CRYSTAL

BACKGROUND OF THE INVENTION

This invention relates to a system and a method for driving a nematic liquid crystal.

When two transparent flat plates having transparent electrodes and sandwiching a nematic liquid crystal are placed between two polarizing plates, transmittance of light passing through the polarizing plates changes with voltages applied to the transparent electrodes.

Since liquid crystal display devices based on the above principle can be shaped flat and are operative with low electric power, they have been widely used in wrist watches, electronic calculating machines, and so forth.

In recent years, they are also used in combination with color filters to form color display devices in note-type personal computers and small liquid crystal TV sets, for example. In such liquid crystal displays, dots of three colors, red, green and blue, are selectively combined to display desired colors. However, color filters are very expensive and need a high accuracy when bonded to panels. Moreover, they need a triple number of dots to ensure an equivalent resolution as compared with black-and-white liquid crystal display panels. Therefore, liquid crystal color panels require a triple number of drive circuits typically in the horizontal direction. This means an increase of the cost of drive circuits themselves and the cost for increased manhours for connecting drive circuits to the panel at a triple number of points.

That is, the use of color filters with liquid crystal panels to display color images involves many disadvantageous factors from the viewpoint of expense.

To avoid the problems caused by the use of color filters, color liquid crystal display devices as disclosed in Japanese Patent Laid-Open 1-179914 (1989) have been proposed to display color images by combining a black-and-white panel and three-color back-lighting in lieu of color filters. Certainly, this method seems more likely to realize high-fidelity color images economically. Actually, however, because of the difficulty in driving liquid crystals at a high speed with conventional drive techniques, no such device has been brought into practice.

Another problem with conventional liquid crystal display devices was slow responses of liquid crystals. Due to this, liquid crystal display devices have been inferior to CRT displays especially when used as TV displays for displaying moving images or as personal computer displays required to follow quick movements of a mouse cursor.

SUMMARY OF THE INVENTION

It is therefore an object of the invention to provide a new system and a method for driving a nematic liquid crystal that can increase the speed of response of any conventional nematic liquid crystals, either TN-type or STN-type, to a value high enough to ensure a performance equivalent to or higher than the performance of a CRT display system when displaying color images by the three-color back-lighting method or reproducing moving images.

According to the present invention, there is provided a system for driving a nematic liquid crystal in a liquid crystal display device in which the nematic liquid crystal is confined between a common electrode and a segment electrode that are placed between two polarizing plates, comprising:

means for applying a sequence of selection pulses to the common electrode;

means responsive to the selection pulses to apply to the segment electrode a voltage corresponding to image data to be displayed; and means for applying a voltage different from the voltage corresponding to the image data to the segment electrode in intervals where the selection pulses are not applied.

According to another aspect of the invention, there is provided a method for driving a nematic liquid crystal in a liquid crystal display device in which the nematic liquid crystal is confined between a common electrode and a segment electrode that are placed between two polarizing plates, comprising the steps of:

applying a sequence of selection pulses to the common electrode;

in response to the selection pulses, applying to the segment electrode a voltage corresponding to image data to be displayed; and applying a voltage different from the voltage corresponding to the image data to the segment electrode in intervals where the selection pulses are not applied.

In both aspects of the invention, the voltage independent from the image data may be switched in level in response to intervals of the selection pulses.

The voltages to the common electrode and the segment electrode are preferably determined such that the voltage to the segment electrode can be inverted in polarity when the selection pulse is applied to the common electrode.

The system preferably includes heater means for heating the nematic liquid crystal to a predetermined temperature.

DETAILED DESCRIPTION OF THE PREFERRED EMBODIMENTS

The invention is characterized in applying a voltage to a liquid crystal at a timing different from that of a conventional liquid crystal drive circuit to increase the response speed of the liquid crystal.

Figure 1:
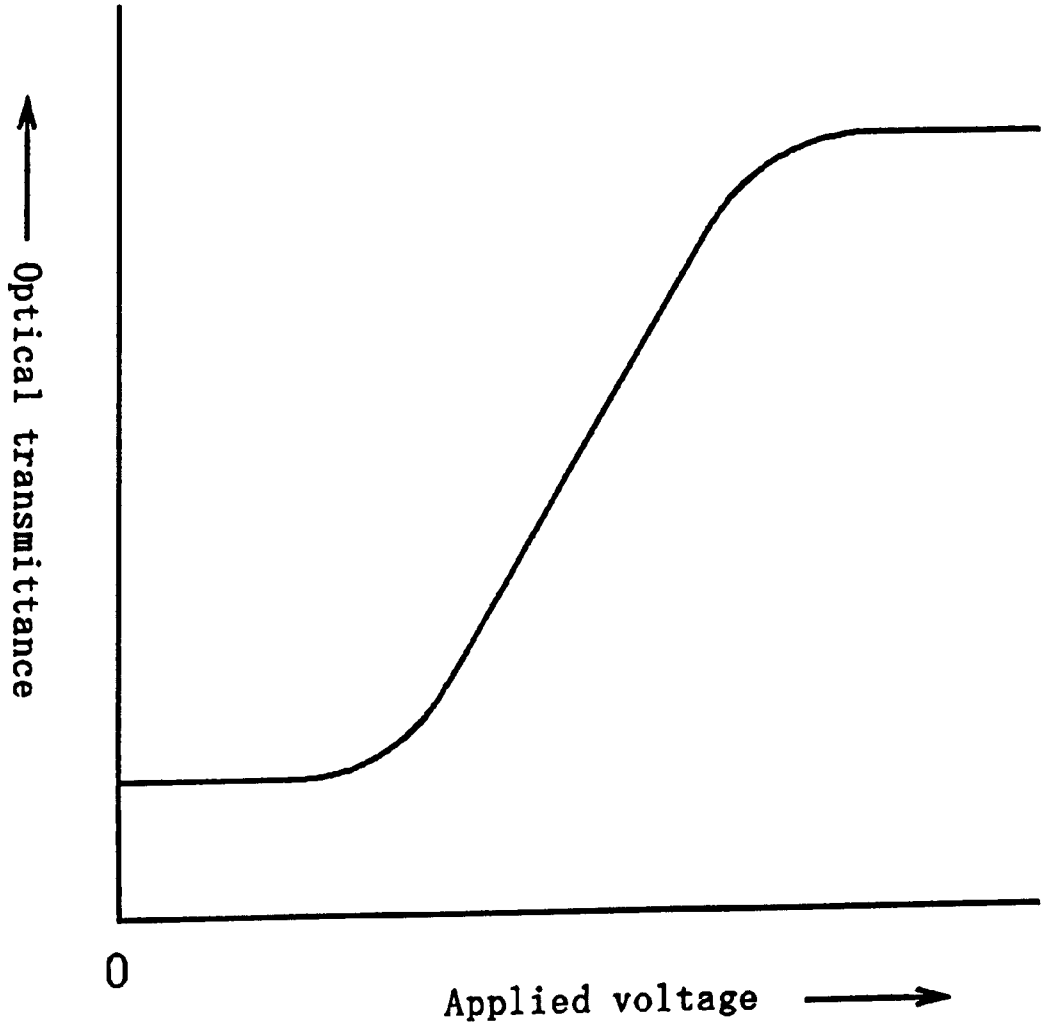
FIG. 1 (PRIOR ART)
FIG. 1 is a diagram showing electro-optic characteristics of a known nematic liquid crystal.

Typical nematic liquid crystals have electro-optic characteristics substantially as shown in FIG. 1 in which the effective value of an applied voltage is material regardless of its polarities.

A driving method called active driving method has been proposed recently as one of driving methods using STN liquid crystal panels to realize a quality of images equivalent to that of TFT liquid crystal panels. That is, in order to improve the contrast ratio and the response speed, the active driving method relies on the approach that selects a plurality of scanning lines simultaneously and more often selects scanning lines in each frame period. This is substantially the same as the conventional driving method in relying on the belief that the optical transmittance of a nematic liquid crystal exclusively depends on the effective value of an applied voltage.

Since nematic liquid crystals need as much time as decades of milliseconds to hundreds of milliseconds for response, it has been believed impossible to realize a speed of response acceptable for displaying color images by three-color back lighting.

The Inventor, however, has found that a specific status of applied voltage waveforms cause quick changes in optical transmittance with change in applied voltage level, while he measured dynamic characteristics of optical transmittance of nematic liquid crystals relative to waveforms of applied voltages for the purpose of developing a liquid crystal panel having a high speed of response sufficient to realize color images by three-color back lighting.

By using this phenomenon and by repeatedly generating the above-mentioned specific status, it has been made possible to drive nematic liquid crystals with a much higher speed and with a higher contrast ratio than those by conventional drive techniques.

The present invention has been made on the basis of the above knowledge.

Figure 2:
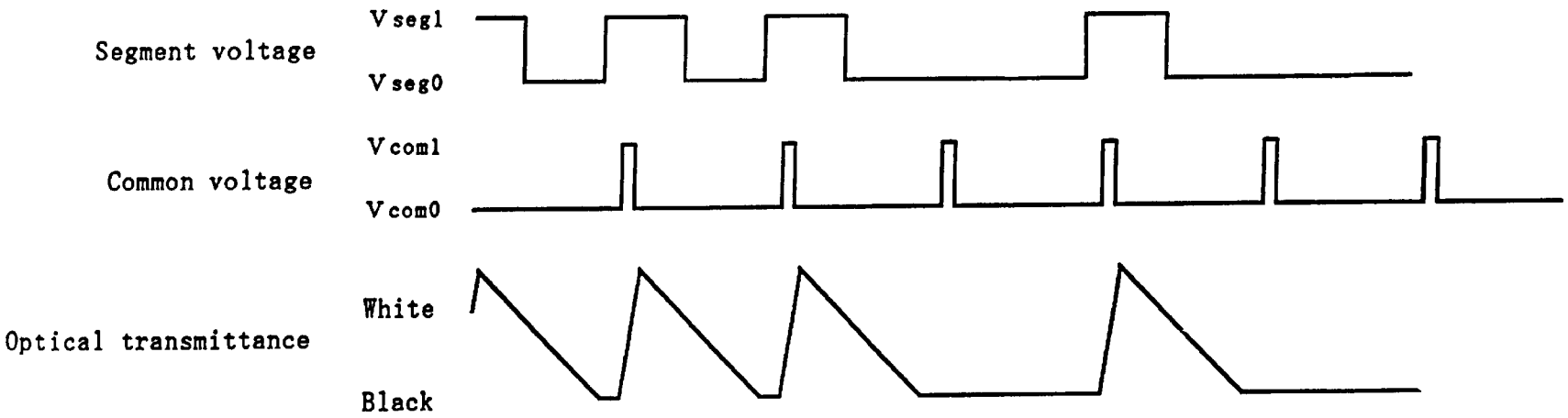
FIG. 2 is a diagram showing changes in optical transmittance with time and with voltage applied to a nematic liquid crystal according to the present invention.

Explained below is an embodiment of the invention with reference to the drawings. FIG. 2 shows an aspect of optical transmittance of a nematic liquid crystal and applied voltages of a single dot in a nematic liquid crystal panel using a simple matrix method. More specifically, FIG. 2 shows changes in optical transmittance on a time base in relation to voltages applied to the segment electrode and the common electrode of a single dot.

As shown in FIG. 2, the voltage applied to the common electrode generates a pulse every time when the common electrode is selected (hereinafter called a common selected period). When the voltage applied to the segment electrode is Vseg1 in the duration of a pulse to the selected common electrode, the optical transmittance of the dot changes instantaneously. When the voltage applied to the segment electrode is Vseg0 in the duration of a pulse, the optical transmittance of the dot does not change. Therefore, when a voltage corresponding to image data is applied to the segment electrode in response to the timing of pulses to the common electrode, images corresponding to the image data can be displayed.

It is important for the driving mode used in this embodiment that, in a frame where the segment voltage level is Vseg1 in the common selected period, the segment voltage level is changed to Vseg0 within the other period of the same frame where the common electrode is not selected (hereinbelow called common non-selected periods).

Figure 3:
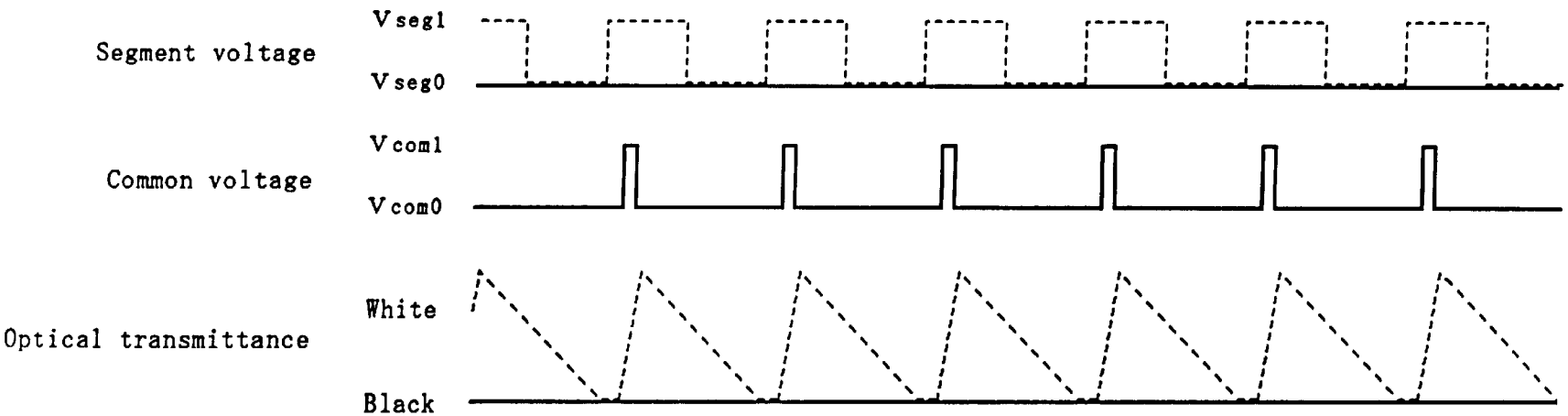
FIG. 3 is a diagram showing changes in optical transmittance with time and with voltage applied to a nematic liquid crystal while maintaining the segment voltage constant.
Figure 4:
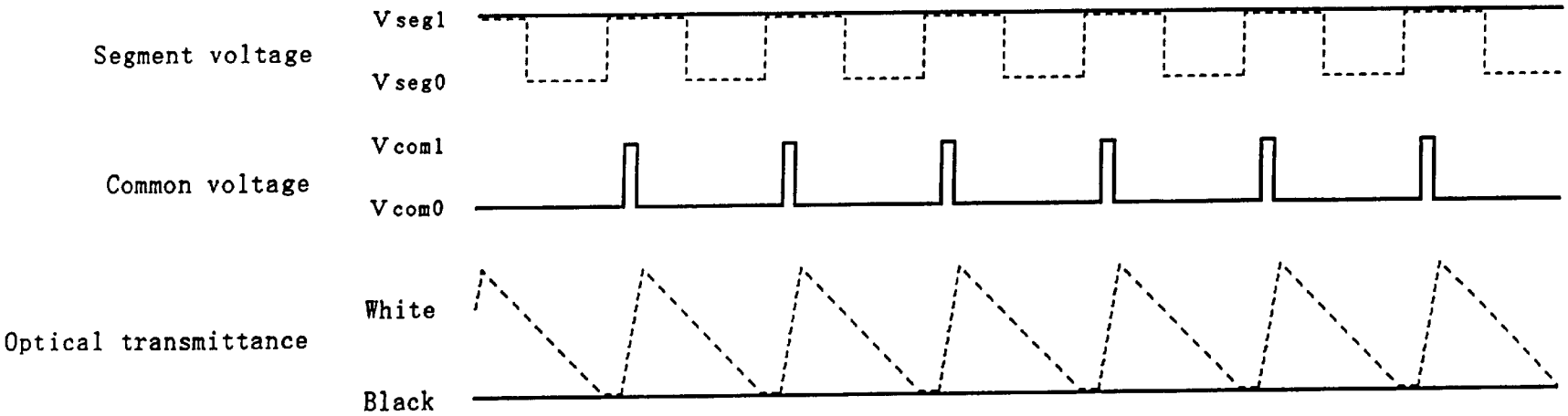
FIG. 4 is a diagram showing changes in optical transmittance with time and with voltage applied to a nematic liquid crystal while maintaining the segment voltage constant.

FIGS. 3 and 4 show voltage waveforms applied by a conventional technique (solid lines) in comparison with those applied by the embodiment of the present invention (broken lines). One difference between the conventional technique and the present invention is that the voltage level applied to the segment electrode is constant, and all of FIGS. 2, 3 and 4 are shown as using a typical TN liquid crystal exhibiting moderate changes in electro-optical characteristics among various nematic liquid crystals as shown in FIG. 1.

If it is true that the optical transmittance of a liquid crystal exclusively depends on the effective value of the voltage applied in a common selected period as conventionally believed, as long as the optical transmittance is low and constant when the segment voltage level is constant, either Vseg0 (FIG. 3) or Vseg1 (FIG. 4), the optical transmittance should remain unchanged even when the segment voltage level changes between Vseg0 and Vseg1 as shown in FIG. 2. Actually, however, the optical transmittance certainly changes as shown in FIG. 2 even when using the typical TN liquid crystal and a panel with a normal thickness, namely with the gap around 5 to 6 $\mu$m. It takes only 15 to 20 ms for the optical transmittance to return to its original value after it begins to change in response to a change in common voltage level. That is, the nematic liquid crystal behaves very quickly.

Quick changes in optical transmittance are most salient when Vcom0 is lower than Vseg0 and Vcom 1 is higher than Vseg1, that is, when the polarity of the voltage level applied in a common selected period is inverted from the polarity of the voltage level applied in a common non-selected period.

With reference to FIG. 2, even when the interval for selecting the common electrode is shortened to one half and the common electrode is selected every time when the segment voltage level becomes Vseg0 in each frame period, no large change occurs in the aspect of optical transmittance.

Note here that the embodiment of FIG. 2 sets the segment voltage level for displaying black at Vseg0 although the segment voltage in a common non-selected period had better Vseg1 for displaying black. This is because it may occur that the common electrode is selected and white is displayed when the interval for selecting the common electrode is shortened to one half.

Figure 5:
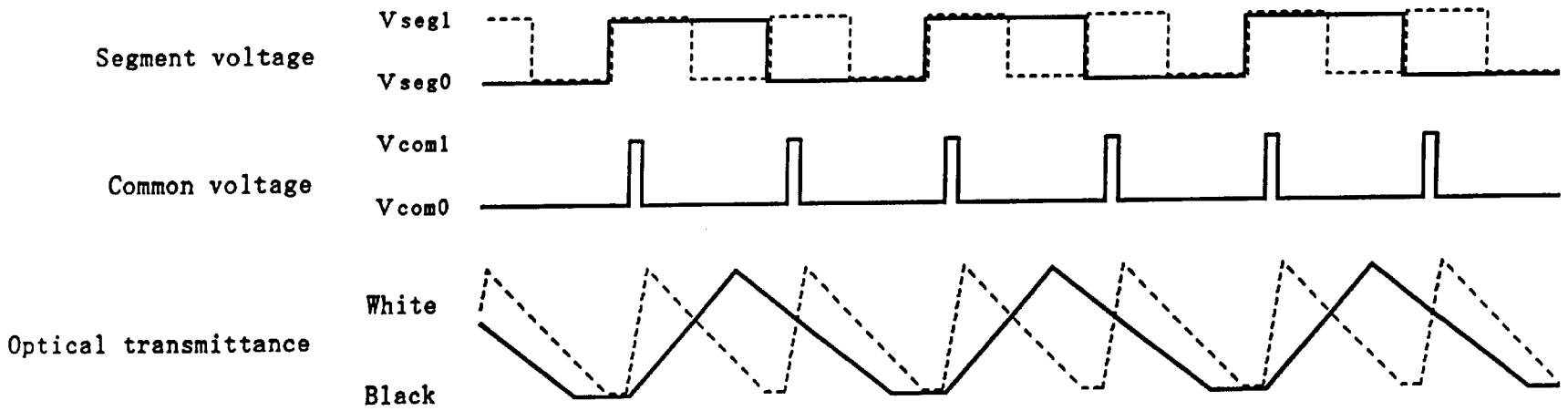
FIG. 5 is a diagram showing changes in optical transmittance with time and with voltage applied to a nematic liquid crystal when the segment voltage changes in intervals of a double length.

FIG. 5 shows how the optical transmittance varies in the embodiment of the invention when the interval for changing the segment voltage level is modified. As shown in FIG. 5, when the segment voltage level is changed from one frame to another, the optical transmittance varies much slower than the speed obtained by changing the segment voltage level within each frame. That is, by changing the segment voltage in faster cycles (shorter intervals), the optical transmittance of a liquid crystal can be changed more quickly.

On the other hand, in order to ensure images with a high contrast ratio, it is preferred that a subsequent pulse be applied after the optical transmittance of the liquid, once changed instantaneously by a preceding pulse to the common electrode, returns to the original value.

That is, as the frame cycle becomes shorter, the contrast ratio becomes lower. In contrast, as the frame cycle becomes longer, flickers are liable to occur.

In order to overcome these contradictory problems simultaneously, some approaches are shown below.

As explained before, the interval for changing the segment voltage level in the non-selected period largely affects the speed of changes in optical transmittance in the embodiment of the invention. Furthermore, the time required for the optical transmittance to return to its original value largely varies with natures of liquid crystals, and particularly with viscosities of liquid crystals. Therefore, by selecting a liquid crystal whose optical transmittance returns to the original value in a short time, images having a high contrast ratio and substantially no flickers can be realized.

Another approach is to heat the liquid crystal panel because the time for returning the optical transmittance to its original value is largely affected by the viscosity of the liquid crystal. This approach is advantageous in promising images of a high contrast ratio without using a special kind of liquid crystal as required in the former approach.

The embodiment described above as being applied to a simple matrix liquid crystal panel can realize a much higher response speed, equivalent contrast ratio, and good visual angle as compared with a TFT liquid crystal panel.

As described above, according to the invention, since an image displayed on a liquid crystal panel in a frame period is erased within the same frame period, a very high response speed optimum for reproduction of moving images can be obtained.

Additionally, the invention not only enables the use of a nematic liquid crystal in a simple matrix liquid crystal panel but also realizes a much higher response speed, equivalent contrast ratio, equivalent or larger visual angle as compared with a conventional TFT liquid crystal panel. It is also possible to apply the invention to a conventional TFT liquid crystal panel to improve the operating speed of the TFT liquid crystal panel.

Moreover, the driving circuit used in the invention can be realized at a cost equivalent to that of a conventional simple matrix driving system because the invention uses a lower number of different drive voltages and an easier driving timing as compared with those of a conventional active driving system that uses many kinds of drive voltages and a complex structure of the controller, which inevitably increases the cost of the driving circuit.

The invention ensuring quick appearance and disappearance of an image is optimum for applications for displaying color images using three color back-lighting, and can realize a high-performance, inexpensive color display.

What is claimed is:

1. A system for driving a simple matrix nematic liquid crystal in a liquid crystal display device in which the nematic liquid crystal is confined between a common electrode and a segment electrode that are placed between two polarizing plates, comprising:

means for applying a sequence of selection pulses to said common electrode;

means responsive to said selection pulses to apply to said segment electrode a voltage having a value corresponding to image data to be displayed; and means for changing the value of the voltage applied to said segment electrode during intervals where said selection pulses are not applied so that the value thereof is different from the value corresponding to the image data.

2. The system for driving a nematic liquid crystal according to claim 1, wherein said voltages applied to said common electrode and said segment electrode are determined to invert a voltage applied to said liquid crystal soon after each said selection pulse is applied to said common electrode.

3. The system for driving a nematic liquid crystal according to claim 1, further comprising means for heating said nematic liquid crystal to a predetermined temperature.

4. The system for driving a nematic liquid crystal according to claim 2, further comprising means for heating said nematic liquid crystal to a predetermined temperature.

* * * * *